United States Patent [19]

Kominami et al.

[11] 4,283,674

[45] Aug. 11, 1981

[54] CONSTANT VOLTAGE OUTPUT CIRCUIT

[75] Inventors: Yasuo Kominami, Kokubunji; Masahiro Yamamura, Kodaira; Katsuji Mizumoto; Toshihide Hanada, both of Sayama, all of Japan

[73] Assignees: Hitachi, Ltd.; Pioneer Electronic Corp., both of Tokyo, Japan

[21] Appl. No.: 59,030

[22] Filed: Jul. 19, 1979

[30] Foreign Application Priority Data

Jul. 19, 1978 [JP] Japan ..... 53-87177

[51] Int. Cl.[3] ..... G05F 3/18

[52] U.S. Cl. ..... 323/313; 330/296

[58] Field of Search ..... 307/296 R, 297; 330/296, 297; 323/1, 4, 19, 22 T, 22 Z

[56] References Cited

U.S. PATENT DOCUMENTS

| | | | |
|---|---|---|---|
| 3,742,338 | 6/1973 | Sugano et al. | 323/1 X |
| 4,030,023 | 6/1977 | Keith | 323/4 |
| 4,103,249 | 7/1978 | Burdick | 323/4 X |

OTHER PUBLICATIONS

Delarue et al., "Circuit Presenting a High Input Impedance", IBM TDB, vol. 19, No. 11, Apr. 1977, pp. 4221, 4222.

*Primary Examiner*—A. D. Pellinen

*Attorney, Agent, or Firm*—Craig and Antonelli

[57] ABSTRACT

This invention relates to a constant voltage output circuit using, as its reference potential source, power source feed terminals for feeding a power source voltage to a reference potential source of a given circuit. The constant voltage output circuit includes a series circuit of an npn transistor and a pnp transistor interposed between the reference potential source of the given circuit and the power source feed terminals, means for biasing the base potential of the pnp transistor by a predetermined potential with respect to the potential of the power source feed terminals, and an emitter follower circuit disposed in the collector output circuit of the npn transistor of the series circuit, and forming a negative feed-back circuit.

6 Claims, 4 Drawing Figures

CONSTANT VOLTAGE OUTPUT CIRCUIT

BACKGROUND OF THE INVENTION

This invention relates to a constant voltage output circuit and more particularly to a constant voltage output circuit for obtaining a constant voltage using a voltage level of an input power source given to a reference potential as its reference.

In an electronic circuit, a constant voltage output circuit is sometimes required in order to obtain a certain constant voltage, which is stabilized with respect to voltage fluctuation of a power source, using, as its reference potential, a power source potential (power source voltage level) given to a reference potential (ground potential) of the electronic circuit. Such a constant voltage output circuit must, first of all, have excellent electrical characteristics. At the same time, it must have a circuit arrangement which does not impose limitation on production techniques of semiconductor integrated circuitry since it may be formed in a semi-conductor substrate such as a silicon substrate together with other necessary electronic circuits.

A constant voltage output circuit such as shown in FIG. 1 would readily be devised as a simple circuit for obtaining a constant voltage by use of a potential at a power source terminal, which feeds a power source voltage to a reference potential of the circuit, as its reference potential, on the contrary. In this circuit the output of a series circuit consisting of a zener diode $Z_{10}$ and a resistor $R_{10}$ is received by an emitter follower circuit consisting of a transistor $Q_{10}$ and a resistor $R_{11}$ to obtain a constant voltage $V_{out}$ from the emitter. As the zener diode $Z_{10}$ is connected on the side of the power source in this circuit, the constant voltage $V_{out}$ is obtained across the collector and emitter of the transistor $Q_{10}$ using a power source voltage level $V_{cc}$ as its reference potential. The circuit of this type uses an npn transistor as an output transistor ($Q_{10}$) for which a large current capacity is required. From the aspect of integrated circuit techniques, the use of the npn transistor is more advantageous than the use of a pnp transistor of a lateral construction calling for a relatively greater occupying area because it minimizes a space requirement in the semiconductor substrate. From the aspect of electric characteristics, however, this constant voltage output circuit is not free from a drawback in that it is not easy to obtain a low output impedance because the output impedance of the constant voltage output circuit relies upon the emitter resistor $R_{11}$ that determines the operating current of the emitter follower circuit.

SUMMARY OF THE INVENTION

It is therefore an object of the present invention to provide a constant voltage output circuit which has a low output impedance and is suited for integration of a semiconductor circuit by use of a power source voltage level as its reference level.

The constant voltage output circuit in accordance with the present invention comprises a series circuit of a pnp transistor and an npn transistor whose emitters are connected with each other; a circuit for feeding a constant voltage between the base of the pnp transistor and a power source line; and an emitter follower output circuit including an npn transistor coupled so as to give negative feed-back to the abovementioned npn transistor. In accordance with the present invention, an npn transistor suited for integration of the circuit is used as an output transistor requiring a large current capacity. Further, the output impedance can be made remarkably small because the npn transistor of the series circuit and the npn transistor of the emitter follower circuit together form the negative feed-back circuit.

The present invention will become more apparent from the following detailed description taken in conjunction with the accompanying drawings.

DESCRIPTION OF THE PREFERRED EMBODIMENTS

Figure 2:
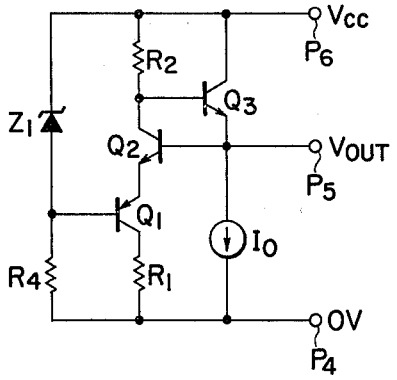

FIG. 2 is a circuit diagram showing an embodiment of the present invention.

This circuit is a constant voltage output circuit for obtaining a constant output voltage $V_{out}$ with respect to a power source voltage level $V_{cc}$, as a reference level, applied to a power source terminal $P_6$ with a ground terminal $P_4$ being a reference potential (ground potential). In other words, the output voltage $V_{out}$ is obtained between the power source terminal $P_6$ and an output terminal $P_5$. A series circuit consisting of a zener diode $Z_1$ and a resistor $R_4$ is a constant voltage producing circuit.

A constant voltage output of the zener diode $Z_1$ is applied to the base of a pnp transistor $Q_1$ and the emitter of an npn transistor $Q_2$ is connected to the emitter of the pnp transistor $Q_1$ so that these transistors $Q_1$ and $Q_2$ together form a modified differential amplification circuit. The abovementioned constant voltage signal is level-shifted in a magnitude corresponding to the base-to-emitter voltages ($V_{BEQ1}$ and $V_{BEQ2}$) of these transistors $Q_1$, $Q_2$ thereby to provide the constant output voltage $V_{out}$.

Resistors $R_1$ and $R_2$ are connected to the collectors of the transistors $Q_1$ and $Q_2$, respectively, and they are bias resistors for determining the operating current of the transistors.

An output npn transistor $Q_3$ having its emitter connected to the base of the transistor $Q_2$ on the output side of the deformed differential amplification circuit and having its base connected to the transistor $Q_2$ constitutes a negative feed-back circuit. A constant current circuit $I_o$ connected to the emitter of this transistor $Q_3$ is to set a bias current to the transistor $Q_3$ in consideration of a load interposed between the terminals $P_5$ and $P_6$.

In the circuit of this embodiment, the transistors $Q_2$ and $Q_3$ form the negative feed-back circuit to obtain the constant output voltage $V_{out}$ as described above. Accordingly, it is possible to drastically reduce the output impedance in comparison with a circuit configuration which merely uses an emitter follower circuit. In other words, the output voltage becomes an extremely small value because it is a value obtained by dividing an output impedance at the time of open loop without negative feed-back by a feed-back quantity. It is therefore possible to make this value smaller than 1/1,000 of the load resistor $R_2$, for example.

In the present invention, a series circuit consisting of the base-emitter paths of the transistors $Q_1$, $Q_2$ and $Q_3$ is wired in parallel to the zener diode $Z_1$. Accordingly, it is possible to restrict fluctuation of the emitter current flowing through the transistors $Q_1$ and $Q_2$ with respect to fluctuation of the power source voltage $V_{cc}$. As a result, it is possible to make the fluctuation of the consumed current relatively small with respect to the power source fluctuation.

In the present invention, further, the output transistor $Q_3$ is formed by an npn transistor. In forming a semiconductor integrated circuit, the output transistor having a large current capacity can be formed with a relatively limited space requirement in a semiconductor chip that forms the semiconductor integrated circuit.

The base-to-emitter voltages $V_{BEQ1}$ and $V_{BEQ2}$ of the transistors $Q_1$ and $Q_2$ and the zener voltage $V_{Z1}$ of the zener diode $Z_1$ fluctuate in accordance with the operating currents flowing through them, respectively. In order to obtain a constant voltage having still higher stability, it is desired to render their bias currents constant.

Figure 1:
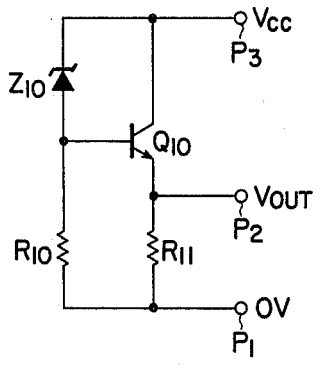
FIG. 1 is a circuit diagram of a constant voltage output circuit constructed by the inventors of the present invention by modifying prior art technique.
Figure 3:
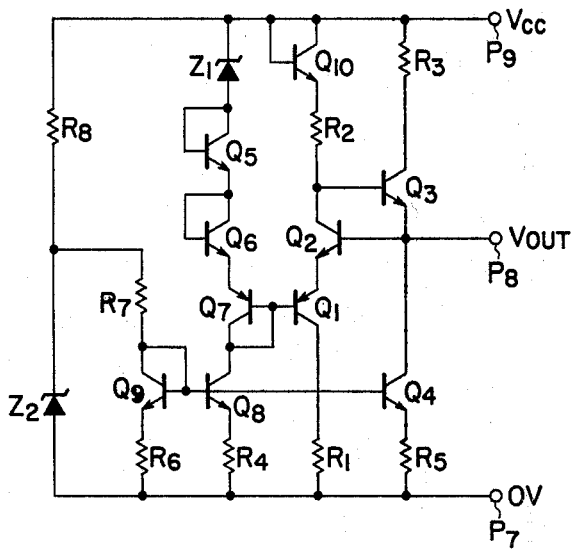
FIGS. 2 and 3 are circuit diagrams of the constant voltage output circuits in accordance with the present invention.

In accordance with the present invention, it is further possible to obtain a constant voltage output circuit having high stability that is temperature-compensated. FIG. 3 is a circuit diagram of another embodiment of the temperature-compensated constant voltage output circuit in accordance with the present invention.

In the circuit shown in FIG. 3, a constant voltage signal to be applied to the base of the pnp transistor $Q_1$ on the input side is obtained from a level shift circuit consisting of a diode-connected pnp transistor $Q_7$ for making temperature compensation of the transistor $Q_1$ on the input side, a diode-connected npn transistor $Q_6$ for making temperature compensation of the npn transistor $Q_2$ on the output side and a diode-connected npn transistor $Q_5$ for making temperature compensation of the zener diode $Z_1$ that forms a constant voltage signal (zener potential; $V_{Z1}$).

An npn transistor $Q_8$ and a resistor $R_4$ connected in series with this level shift circuit constitute a constant current circuit for forming a bias current to the level shift circuit. A resistor $R_7$, a diode-connected pnp transistor $Q_9$ and a resistor $R_6$ are connected at both ends, or at the constant voltage output, of a zener diode $Z_2$, which forms a constant voltage circuit together with a resistor $R_8$, so as to produce a constant current, and the bases of the transistors $Q_9$ and $Q_8$ are mutually connected thereby to constitute a current mirror circuit and to supply the collector of the transistor $Q_8$ with a constant bias current.

On the other hand, a diode-connected npn transistor $Q_{10}$ is disposed on the collector side of the transistor $Q_2$ which forms the modified differential amplification circuit together with the transistor $Q_1$.

A constant current circuit consisting of a transistor $Q_4$ and a resistor $R_5$ is connected to the emitter of the output npn transistor $Q_3$ forming the negative feed-back circuit, said transistor $Q_4$ being driven by the transistor $Q_9$ biased by the constant current.

The output voltage $V_{out}$ produced across the terminals $P_8$ and $P_9$ of this circuit can be obtained by the equation (1) below;

$$V_{out}=V_{cc}-V_{Z1}-V_{BEQ5}-V_{BEQ7}+V_{BEQ1}+V_{BEQ2} \quad (1)$$

where $V_{BEQ1}$, $V_{BEQ2}$, $V_{BEQ5}$, $V_{BEQ6}$ and $V_{BEQ7}$ are base-to-emitter voltages of the transistors $Q_1$, $Q_2$, $Q_5$, $Q_6$ and $Q_7$, respectively, and $V_{Z1}$ is a zener voltage of the zener diode $Z_1$. p It is hereby assumed that the zener voltage $V_{Z1}$ has a positive temperature coefficient or the zener diode $Z_1$ used has a zener voltage such as 5.6 V, for example. On the other hand, since the base-to-emitter voltage $V_{BE}$ of the transistor has a negative temperature coefficient, temperature compensation in the circuit of this embodiment is carried out by providing the zener diode $Z_1$ with the transistor $Q_5$ so as to mutually offset their temperature coefficients. As can also be seen clearly from the equation (1), the fluctuation of the base-to-emitter voltage of the transistor $Q_6$ is compensated by the transistor $Q_2$ and that of the transistor $Q_7$, by the transistor $Q_1$. As a result, it is possible to make the temperature compensation of the output voltage $V_{out}$.

Figure 4:
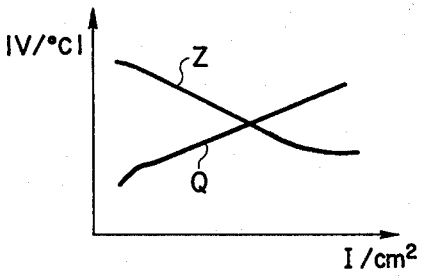
FIG. 4 is a diagram showing current density-v-temperature coefficient curves of a zener diode and a transistor, respectively.

The absolute values of the temperature coefficients of the zener diode Z and the transistors Q vary depending on the current density as shown in FIG. 4.

In this embodiment, therefore, a current value is so set in consideration of element sizes as to obtain a current density at the point of intersection of the curves Z and Q at which the absolute values of the temperature coefficients of the zener diode $D_1$ and the transistor $Q_5$ become equal to each other. The density of the current flowing through the transistor $Q_7$ is made equal to the density of the current flowing through the transistor $Q_1$ while the current density of the transistor $Q_6$ is made equal to that of the transistor $Q_2$.

It is of course possible to let the current densities of the transistors $Q_6$ and $Q_7$ relatively coincide with those of the transistors $Q_1$ and $Q_2$.

Assuming now that the element size of the transistor $Q_6$ is made coincide with that of the transistor $Q_2$ and the size of the transistor $Q_7$, with that of the transistor $Q_1$, so as to make their current values coincide with each other, respectively, and thus make their current densities coincide with each other. In this case, the current $I_1$ flowing through the level shift circuit can be obtained by the equation (2) below:

$$I_1 = \frac{V_{Z2} - V_{BEQ9}}{R_7 + R_6} \quad (2)$$

where $V_{Z2}$ is a zener voltage of the zener diode $Z_2$ and $V_{BEQ9}$ is a base-to-emitter voltage of the transistor $Q_9$.

Since the transistors $Q_9$ and $Q_8$ together constitute the current mirror circuit, the current flowing through the transistor $Q_9$ can be made equal to the current $I_1$ flowing through the transistor $Q_8$ by making the resistor $R_4$ equal to the resistor $R_6$. In other words, the current $I_1$ of the abovementioned level shift circuit can be obtained from the equation (2).

The base currents of the transistors $Q_8$, $Q_9$ and $Q_4$ in the current mirror circuit are neglected in the formula (2) because they are insignificant. If necessary, however, a transistor may be added in order to correct these base currents.

On the other hand, a current $I_2$ flowing through the differential transistor circuit consisting of the pnp transistor $Q_1$ and npn transistor $Q_2$ can be obtained from the equation (3) below:

$$I_2 = \frac{V_{Z1} - V_{BEQ10}}{R_2} \quad (3)$$

where $V_{BEQ10}$ is a base-to-emitter voltage of the transistor $Q_{10}$.

As can be seen clearly from the equation (3), the voltage level-shifted by the transistors $Q_5$–$Q_7$ is compensated by the transistors $Q_1$–$Q_3$ so that the voltage produced at the transistor $Q_{10}$ and the resistor $R_2$ becomes equal to the abovementioned zener voltage $V_{Z1}$, thereby providing the current $I_2$ from the equation (3).

In the abovementioned equations (2) and (3), the current $I_1$ becomes substantially equal to the current $I_2$ if the zener diodes $Z_1$ and $Z_2$ have the same characteristics so as to satisfy the equation $V_{Z1}=V_{Z2}$ and if $R_6+R_7$ is $R_2$. When the current $I_1$ is equal to the current $I_2$, the base-to-emitter voltage $V_{BEQ9}$ of the transistor $Q_9$ is equal to the base-to-emitter voltage $V_{BEQ10}$ of the transistor $Q_{10}$. For this reason, the current $I_1$ is perfectly equal to the current $I_2$ as can be seen clearly from the equations (2) and (3).

The constant of each element determining these current values changes similarly depending on the temperature change and no relative change occurs between both current values so that it is possible to satisfy the relation $$\frac{\alpha I_1}{\alpha T} = \frac{\alpha I_2}{\alpha T}.$$

Accordingly, the relations $-V_{BEQ6}+V_{BEQ2}=0$ and $-V_{BEQ7}+V_{BEQ1}=0$ can be satisfied from the equation (1) over the entire temperature range to be compensated for and a stable output voltage $V_{out}$ can be obtained.

Especially, by forming the circuit of this embodiment in a monolithic semiconductor integrated circuit, it is easy to obtain matching of the temperature characteristics between the transistor and the zener diode and a predetermined ratio of resistance between the resistors and also to make their changes with respect to the temperature change equal to each other. Hence, it is possible to obtain an extremely stable output voltage $V_{out}$.

The circuit of this embodiment makes it possible to obtain a stable output which is stable not only with respect to the temperature change but also to the fluctuation of the power source voltage $V_{cc}$.

In the circuit of this embodiment, further, it is necessary to make the current flowing through the transistor $Q_3$ equal to the abovementioned current $I_1$. This is because the equation (3) is formulated on the premise that the base-to-emitter voltage $V_{BEQ3}$ of the transistor $Q_3$ is equal to the base-to-emitter voltage $V_{BEQ5}$ or $V_{BEQ6}$ of the transistor $Q_5$ or $Q_6$.

For the reason described above, the bias current of this transistor $Q_3$ is formed by the transistor $Q_9$ and the transistor $Q_4$, the latter driving the current mirror circuit together with the resistor $R_5$, as shown in the drawing.

As illustrated in the above-described embodiments, the constant voltage output circuit in accordance with the present invention obtains an output voltage using the differential transistors $Q_1$ and $Q_2$ to make a level shift. Hence, it is possible to provide a level shift circuit for temperature compensation in a circuit which is to produce a reference voltage, and also to optionally set a current to the level shift circuit and the differential circuit. Accordingly, coincidence of the current densities can be made freely in consideration of the element sizes and the temperature compensation can be made easily.

As noted in the foregoing paragraph, the present invention is especially effective as a constant voltage circuit for obtaining a constant voltage using a potential of the power source voltage applied to a reference potential of the circuit, as its reference potential, on the contrary. Hence, the present invention is effective for such a circuit as a drive control circuit of a d.c. motor, for example, where a positive power source voltage is applied with respect to the reference potential source of the circuit, and a given constant voltage using the power source voltage level as a reference level is required.

It is to be noted that various modifications and changes may be apparent to those skilled in the art without departing from the spirit and the scope of the invention.

What is claimed is:

1. A constant voltage output circuit comprising:

first and second power source terminals for supplying a power source voltage;

a series circuit consisting of a first pnp transistor and a first npn transistor, each having its emitter connected to the emitter of the other;

means for connecting the collector of said first pnp transistor to said first power source terminal;

load means interposed between the collector of said first npn transistor and said second power source terminal;

a second npn transistor having its base connected to the collector of said first npn transistor, its collector connected to said second power source terminal and its emitter connected to the base of said first npn transistor as well as connected to said first power source terminal via second load means;

reference voltage feed means for impressing a reference voltage across the base of said first pnp transistor and said second power source terminal; and an output terminal connected to the emitter of said second npn transistor, thereby providing a constant output voltage across it and said second power source terminal.

2. The constant voltage output circuit as defined in claim 1 wherein said reference voltage feed means consists of:

constant voltage diode means interposed between the base of said first pnp transistor and said second power source terminal; and third load means for supplying said constant voltage diode means with a bias current, said third load means interposed between the base of said first pnp transistor and said first power source terminal.

3. The constant voltage output circuit as defined in claim 2 wherein said third load means consists of a constant current circuit for feeding a constant current to said constant voltage diode means.

4. The constant voltage output circuit as defined in claim 3 wherein said constant current circuit comprises:

a third npn transistor having its collector-emitter path interposed between the base of said first pnp transistor and said first power source terminal;

a diode-connected fourth pnp transistor interposed between the base of said third npn transistor and said first power source terminal, thereby forming a current mirror circuit together with said third transistor; and means for supplying a bias current to said fourth transistor.

5. The constant voltage output circuit as defined in any one of claims 2, 3 or 4 wherein said constant voltage diode means comprises a series circuit consisting of a diode-connected pnp transistor, a diode-connected npn transistor and a zener diode connected in series with one another.

6. The constant voltage output circuit as defined in any one of claims 1, 2, 3 or 4 wherein said second load means comprises a constant current circuit including an npn transistor interposed between the emitter of said second npn transistor and said first power source terminal.

* * * * *